US005458722A

United States Patent [19]

Gläser et al.

[11] Patent Number: 5,458,722

[45] Date of Patent: Oct. 17, 1995

[54] METHOD AND LOCKING DEVICE, FOR CONNECTING IN A LIQUID-TIGHT MANNER WALL SECTIONS OF A MULTI-SECTIONED WALL

[75] Inventors: Eberhard Gläser, Aichwald; Reiner Möck, Pfullingen, both of Germany

[73] Assignee: Ed. Züblin Aktiengesellschaft, Stuttgart, Germany

[21] Appl. No.: 282,724

[22] Filed: Jul. 29, 1994

[30] Foreign Application Priority Data

Jul. 31, 1993 [DE] Germany ..... 43 25 751.8

[51] Int. Cl.[6] ..... B32B 1/08

[52] U.S. Cl. ..... 156/293; 156/294; 156/303.1; 156/308.4; 405/279; 405/280; 405/281

[58] Field of Search ..... 405/279, 280, 405/281, 267; 186/293, 294, 303.1, 304.2, 304.5, 304.6, 308.4

[56] References Cited

U.S. PATENT DOCUMENTS

| | | | |
|---|---|---|---|
| 4,671,705 | 6/1987 | Nussbaumer et al. | 405/267 |
| 4,838,980 | 6/1989 | Gläser et al. . | |
| 4,990,210 | 2/1991 | Gläser et al. . | |

FOREIGN PATENT DOCUMENTS

| | | | |
|---|---|---|---|
| 3520817 | 12/1986 | Germany . | |
| 3637298 | 5/1988 | Germany . | |
| 1215893 | 9/1986 | Japan | 156/293 |
| 8600898 | 11/1987 | Netherlands | 405/279 |

*Primary Examiner*—Michael W. Ball
*Assistant Examiner*—Sam Chuan Yao
*Attorney, Agent, or Firm*—Robert W. Becker

[57] ABSTRACT

A method for connecting in a liquid-tight manner cooperating lock halves of a locking device of adjacent wall sections of a multi-sectioned wall introduced into a suspension includes providing a first lock half as an inner profiled member and a second lock half as an outer profiled member. The inner profiled member is inserted into the outer profiled member so that the profiled members substantially areally rest at one another and form a capillary gap. An inner groove is cut over the length of the lock halves such that the inner groove extends through the wall of the inner profiled member into the wall of the outer profiled member. The area of the wall of the inner profiled member where the inner groove is located is sealed against the suspension with a sealing material introduced into the gap. The inner and outer profiled members are fused with a fusing material introduced into the inner groove. In an alternative embodiment a receiving groove is provided in the wall of the inner or outer profiled member such that the area where the inner groove is located is sealed by a sealing material introduced into the receiving groove.

14 Claims, 5 Drawing Sheets

METHOD AND LOCKING DEVICE, FOR CONNECTING IN A LIQUID-TIGHT MANNER WALL SECTIONS OF A MULTI-SECTIONED WALL

BACKGROUND OF THE INVENTION

The present invention relates to a method for connecting in a liquid-tight manner the locking halves of a locking device of wall sections positioned within a suspension, a locking device for the use in connection with the inventive method, as well as a fusing or welding device for connecting the locking halves of the locking device.

A method of the aforementioned kind as well as a locking device are known from German Patent 36 37 298. The locking device is comprised of an inner profiled member and an outer profiled member which are connected respectively to a vertical longitudinal edge of a wall section of the multi-sectioned wall to be formed. After inserting the tubular inner connecting element (profiled member) into the outer tubular profiled member already positioned within the suspension in which the multi-sectioned wall is to be installed, a cutting device is inserted into the inner hollow space of the locking device which cutting device cuts over the length of the profiled members an inner groove which extends through the wall of the inner profiled member into the wall of the outer profiled member. Subsequently, a profiled piece for fusing that has been preheated to the fusing (welding) temperature is introduced into the inner groove and fused with the walls of the inner groove such that the inner and outer profiled members are connected to one another in a liquid-tight manner.

For fusing the profiled elements an extruder fusing (welding) device is known from German Patent 35 20 817 to which correspond U.S. Pat. Nos. 4,838,980 and 4,990,210. With this device a plasticized fusing material is introducted into the inner groove and is then fused to the groove walls in a liquid-tight manner. In practice it has been demonstrated that already shortly after the insertion of the inner profiled member the suspension in which the multi-sectioned wall is to be installed, respectively, the liquid of the suspension penetrates into the gap between the inner and outer profiled members and exits into the cut inner groove. The groove walls which are to be used as contact surfaces for the fusing step are thus soiled. A liquid-tight fusing connection can be achieved with soiled contact surfaces only with great difficulties, and under certain circumstances it is impossible to produce such a fused connection.

It is therefore an object of the present invention to improve the method of the aforementioned kind such that for the fusing operation the contact surfaces in the form of the walls of the groove are clean, dry, and free of any suspension for the fusing step. Furthermore, a locking device for the use with the inventive method as well as a fusing device for performing the method will be disclosed.

SUMMARY OF THE INVENTION

A method for connecting in a liquid-tight manner cooperating lock halves of a locking device of adjacent wall sections of a multi-sectioned wall introduced into a suspension is primarily characterized by the following steps:

Providing a first one of the cooperating lock halves as an inner profiled member and a second one of the cooperating lock halves as an outer profiled member;

Inserting the inner profiled member into the outer profiled member so that the inner and outer profiled members substantially areally rest at one another and form a capillary gap therebetween;

Cutting an inner groove substantially over the length of the inner and outer profiled members such that the inner grooves extends through the wall of the inner profiled member into the wall of the outer profiled member;

Sealing the area of a wall of the inner profiled member where the inner groove is located with a sealing material introduced into the gap against the suspension into which the multi-sectioned wall is introduced; and Fusing the inner and outer profiled members with a fusing material introduced into the inner groove.

Preferably, the step of sealing includes the step of spraying the sealing material onto the walls of the inner groove after the step of cutting, wherein the sealing material is a compound reacting with a suspension under silicification to close the capillary gap.

Preferably, the method further comprises the step of cleaning the walls of the inner groove before the step of fusing.

Advantageously, in the step of cleaning a cleaning operation such as brushing or milling is performed.

Preferably, the step of sealing includes the step of spraying the sealing material onto walls of the inner groove during the step of cutting, wherein the sealing material is a compound reacting with a suspension under silicification to close the capillary gap.

Preferably, the step of cutting the inner groove is comprised of the step of precutting a narrow groove of a size smaller than the inner groove and the step of finishing-cutting the narrow groove to the finished size of the inner groove, wherein after the step of precutting the step of spraying is performed and wherein subsequent to the step of spraying, after a given time period, the step of finishing cutting is performed.

Preferably, the method further comprises the step of cleaning the walls of the inner groove before the step of fusing, preferably by cleaning operations such as brushing and milling.

In a preferred embodiment of the present invention the step of sealing includes the step of filling the interior of the inner profiled member with a sealing material, wherein the sealing material is a compound reacting with a suspension under silicification to close the capillary gap. Preferably this method further comprises the step of cleaning the walls of the inner groove before the step of fusing by cleaning operations such as brushing and milling.

In an alternative embodiment of the present invention the method for connecting in a liquid-tight manner cooperating lock halves of a locking device of adjacent wall sections of a multi-sectioned wall introduced into a suspension preferably comprises the steps of:

Providing a first one of the cooperating lock halves as an inner profiled member with a wall having an outer wall surface and a second one of the cooperating lock halves as an outer profiled member with a wall having an inner wall surface;

Inserting the inner profiled member into the outer profiled member so that the inner and outer wall surfaces of the inner and outer profiled members substantially areally rest at one another and form a capillary gap therebetween;

Cutting an inner groove substantially over the length of the inner and outer profiled members such that the inner groove extends through the wall of the inner profiled member into the wall of the outer profiled member;

Fusing the inner and outer profiled members with a fusing material introduced into the inner groove; and Before the step of inserting, positioning a sealing material between the inner and outer wall surfaces of the inner and outer profiled members to surround an area of the inner and outer walls where the inner groove is to be located, wherein the sealing material is arranged on one of the inner and outer walls in order to seal the area where the inner groove is to be located against the suspension into which the multi-sectioned wall is introduced.

The present invention further relates to a locking device for connecting in a liquid-tight manner cooperating lock halves of adjacent wall sections of a multi-sectioned wall introduced into a suspension, wherein the inner profiled member and the outer profiled member form cooperating lock halves of the locking device and the inner profiled member is inserted into the outer profiled member so that the inner and outer profiled members substantially areally rest at one another, wherein an inner groove is cut substantially over a length of the inner and outer profiled members such that the inner groove extends through a wall of the inner profiled member into a wall of the outer profiled member and the inner and outer profiled members are fused with a fusing material introduced into the inner groove. The locking device according to the present invention is primarily characterized by:

An outer profiled member connected to a vertical edge of a first wall section and having an inner wall surface;

An inner profiled member connected to a vertical edge of a second wall section and having an outer wall surface;

The inner profiled member inserted into the outer profiled member such that the outer wall surface substantially areally rests at the inner wall surface; and A sealing material connected to at least one of the inner wall surface and the outer wall surface, wherein the sealing material, when the inner profiled member is inserted into the outer profiled member, surrounds an area of the inner and outer wall surfaces where the inner groove is to be cut.

Preferably, the sealing material swells when subjected to moisture. Preferably, the sealing material is a plasticized material.

Advantageously, the at least one of the inner and outer wall surfaces has a receiving groove and the sealing material is positioned in the receiving groove and is in the form of a shaped elastic material. Preferably, the shaped elastic material is a sealing rope.

Expediently, the receiving groove is completely filled with the shaped elastic material. The shaped elastic material may be fastened within the receiving groove by gluing.

Advantageously, the locking member further comprises a protective foil for covering the receiving groove with a shaped elastic material positioned therein.

In a preferred embodiment of the present invention, the receiving groove has a trapezoidal cross-section.

The receiving groove advantageously is located on the outer wall surface. The receiving groove in a preferred embodiment is U-shaped, wherein the opening of the U is facing an upper end of the inner profiled member and wherein the receiving groove ends at the upper end of the inner profiled member.

Preferably, the receiving groove is U-shaped wherein the opening of the U is facing the upper end of the at least one inner and outer profiled members and wherein the receiving groove ends at the upper end.

Preferably, the lower end of the inner profiled member is closed.

According to the present invention before fusing (welding) the inner and outer profiled members the area of the wall into which the inner groove is to be cut is sealed with a sealing material that is introduced into the capillary gap between the profiled elements such that the fusing contact surfaces remain clean, dry, and free of suspension in which the multi-sectioned wall is positioned. A liquid-tight fusing is thus ensured with great reliability.

In a preferred embodiment of the present invention, after, preferably during the cutting of the groove, a sealing material is sprayed onto the groove walls whereby the sealing material is preferably a liquid that reacts with the suspension penetrating the capillary gap so as to close the capillary gap by silicification. The liquid penetrates after spraying into the capillary gap and reacts with the suspension leaking into the gap such that the capillary gap is blocked by silicification. Before the subsequent fusing process the fusing contact surfaces are cleaned, especially brushed, in order to ensure proper fusing.

In a preferred embodiment the sealing material is arranged between the inner wall surface of the outer profiled member and the outer wall surface of the inner profiled member before introducing the inner profiled member into the outer profiled member whereby the sealing material surrounds the wall surface area into which the groove is to be cut. Preferably, the sealing material is arranged within the wall of one of the inner and outer profiled members, especially arranged at the outer wall surface of the inner profiled member, and is comprised of a material that swells upon exposure to moisture. After insertion of the respective wall sections into the suspension the moisture of the suspension causes a swelling of the sealing material so that a sealing of the capillary gap results and the wall area into which the groove is to be cut is secured against introduction of suspension or liquid. A soiling of the fusing contact surfaces by liquid leaking from the gap into the groove is thus reliably prevented.

A locking device for the liquid-tight connection of wall sections of a multi-sectioned wall positioned within a suspension according to the present invention is comprised of an outer profiled member connected to the vertical edge of a first wall section and having a wall with an inner wall surface, an inner profiled member connected to the vertical edge of a second wall section and having a wall with an outer wall surface, wherein the inner profiled member is inserted into the outer profiled member such that the outer wall surface substantially rests at the inner wall surface, and a sealing material connected to at least one of the inner and outer wall surfaces, wherein the sealing material, when the inner profiled member is inserted into the outer profiled member, surrounds an area of the inner and outer wall surfaces where the inner groove is to be cut. Accordingly, at least one of the facing inner and outer wall surfaces of the profiled members is provided with a sealing material which surrounds the area where the inner groove is to be located. Preferably, the sealing material is arranged within a receiving groove and the receiving groove with the introduced sealing material is covered by a protective foil. Shortly before the inner and outer profiled members are to be connected to one another, the protective foil is removed so that moisture exposure and thus a swelling of the sealing material to effect sealing is possible.

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 11.

Figure 1:
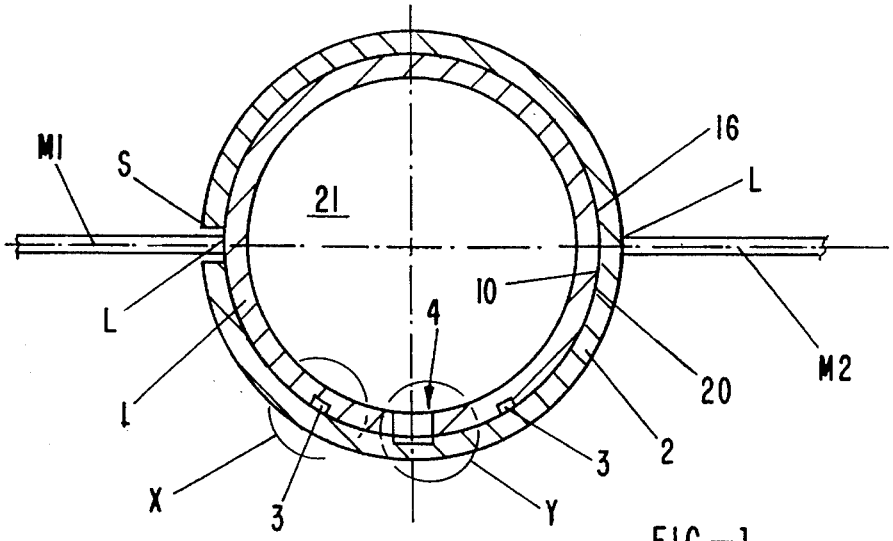
FIG. 1 shows a horizontal section of a locking device for connecting wall sections of a multi-sectioned wall.
Figure 2:
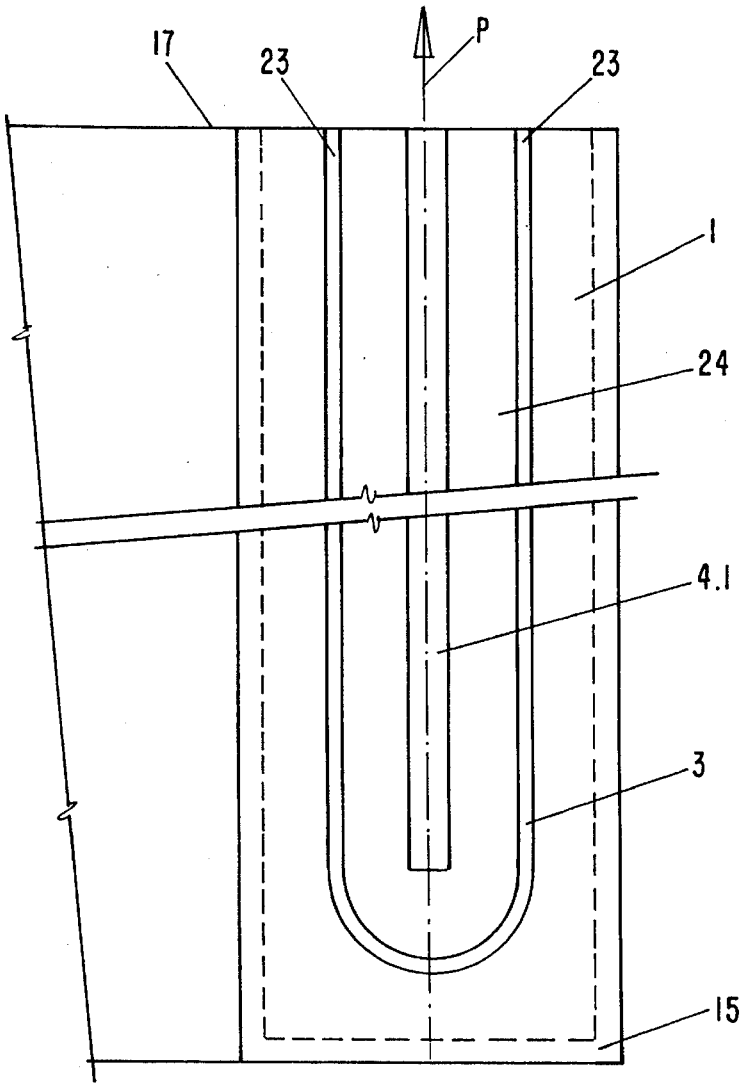
FIG. 2 shows an end view of an inner profiled member of the locking device viewed in the direction of arrow P in FIG. 1.

The locking device represented in FIG. 1 serves to connect in a liquid-tight manner the wall sections M1 and M2 of a multi-sectioned wall placed into a suspension. To one vertical longitudinal edge L of the areal wall section M1 one locking half is connected which in the shown embodiment is comprised of an inner profiled member 1, especially a profiled tube. The inner profiled member 1 which forms the inner locking half of the locking device is closed at its bottom end 15 (FIG. 2) so that a cylinder is formed which at one end is closed off in a liquid-tight manner. The inner profiled member 1 is inserted into an outer profiled member 2 which is positioned within the suspension in which the multi-sectioned wall is to be formed. The profiled member 2 is connected to the vertical longitudinal edge L of the adjacently arranged wall section M2 in a liquid-tight manner. The outer profiled member 2 is provided with a slot S with which the wall section M1 fused to the inner profiled member 1 is guided.

The inner profiled member 1 and the outer profiled member 2 are dimensioned such that the outer wall surface 10 of the inner profiled member 1 rests approximately at the inner wall surface 20 of the outer profiled member 2. Preferably, the inner and outer wall surfaces 10, 20 rest over their entire length and approximately over their entire circumference at one another in an areal manner. The profiled members 1, 2 and the wall sections M1, M2 are comprised of a plastic material, especially high density polyethylene etc.

Figure 9:
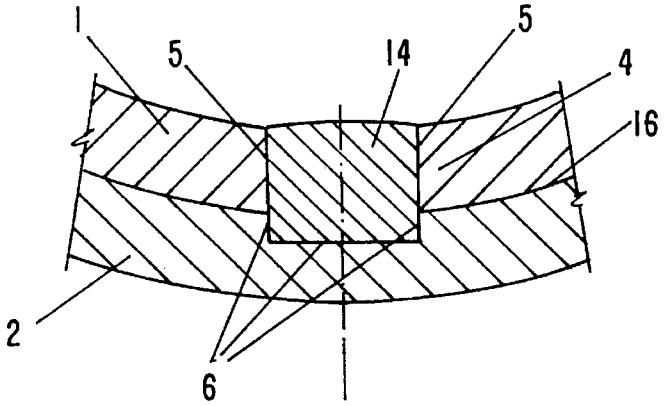
FIG. 9 shows a representation according to FIG. 8 with the fusing material filling the inner groove.
Figure 11:
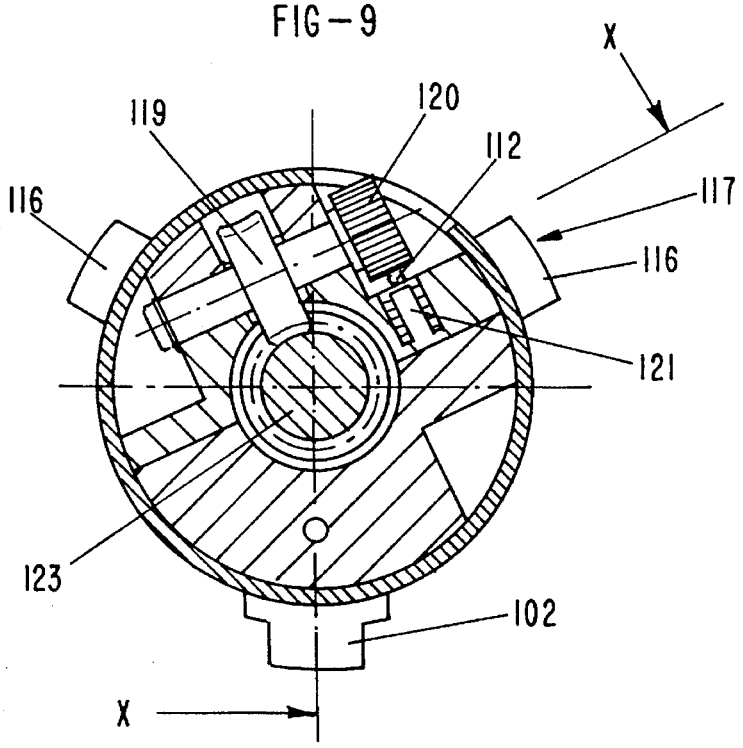
FIG. 11 shows a section along the line XI—XI of FIG. 10.

After placing the outer profiled member 2 into the suspension in which the sectioned wall is to be formed and after insertion of the inner profiled member 1 into the outer profiled member 2 an inner groove 4 is cut or milled over substantially the length of the locking device in the longitudinal direction of the profiled members 1, 2 with a device that is inserted into the interior hollow space 21. As can be seen from the enlarged representation of FIG. 6, the inner groove 4 extends through the wall of the inner profiled member 1 and extends into the wall of the outer profiled member 2. The inner groove 4 is thus comprised of a slot 4.1 within the wall of the inner profiled member 1 and a congruently positioned groove bottom 4.2 within the wall of the outer profiled member 2. For a liquid-tight connection of the inner and the outer profiled members 1 and 2 a plasticized plastic fusing material (fusing rope) 13 is applied to the walls 6 of the groove bottom 4 as well as the walls 5 of the slot 4.1 so that the capillary gap 16 between the wall surfaces 10 and 20 are closed off in a liquid-tight manner over the length of the locking device. The fusing material (fusing rope) 13 which is introduced into the inner groove 4 by the extruder fusing device inserted into the hollow space 21 forms a U-shaped fusing (welding) seam. As can be seen in FIG. 9, the fusing (welding) seam 14 can also be formed by completely filling the inner groove 4 whereby the fusing seam preferably projects in the direction of the inner hollow space 21 past the inner wall surface of the profiled member 1.

Figure 8:
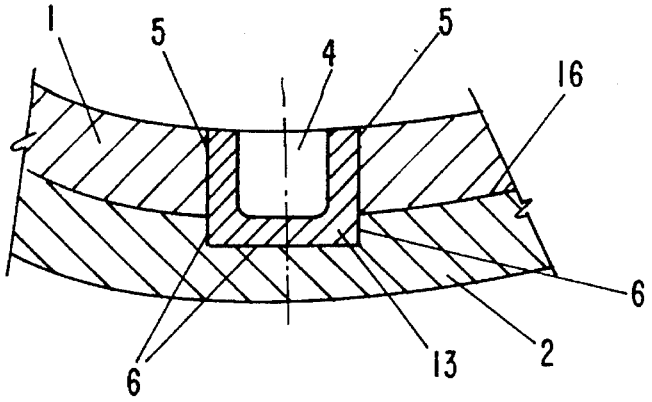
FIG. 8 shows in an enlarged representation the detail Y of FIG. 1 with the fusing material introduced into the inner groove.

The fusing seam represented in FIGS. 8 and 9 is produced by the extruder fusing (welding) device. It may be advantageous that the fusing seam 14 represented in FIG. 9 is produced by a fusing profiled piece which is forced, in a partially plasticized condition, into the inner groove 4 that has been brought to the fusing temperature.

When a locking device is introduced into the suspension (FIG. 1), it cannot be completely prevented that via the gap 16 between the outer wall surface 10 of the inner profiled member 1 and the inner wall surface 20 of the outer profiled member 2 suspension material, especially liquid contained in the suspension material, can enter the inner groove 4. In order to prevent penetration of the liquid or suspension into the inner groove 4, it is suggested to protect the wall section 24 into which the groove 4 is to be cut and the fusing seam at least for a certain amount of time against leaking liquid. In a preferred embodiment it is suggested to provide in the outer wall surface 10 of the inner profiled member 1 a substantially U-shaped receiving groove 3. The bottom of the U is positioned at a small distance to the lower closed end 15 of the inner profiled member 1. The opening of the U faces the upper end 17 of the inner profiled member 1 whereby the ends 23 of the receiving groove 3 preferably end at the upper edge of the upper end 17.

Figure 3:
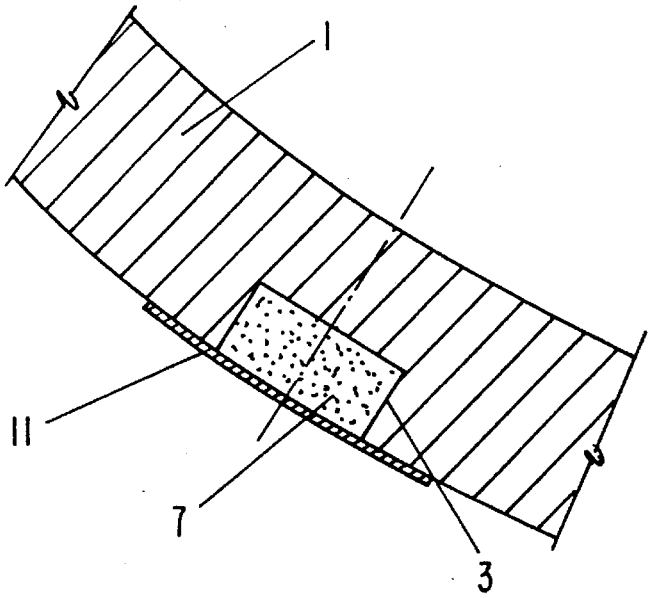
FIG. 3 shows in an enlarged representation detail X (receiving groove) of FIG. 1.
Figure 4:
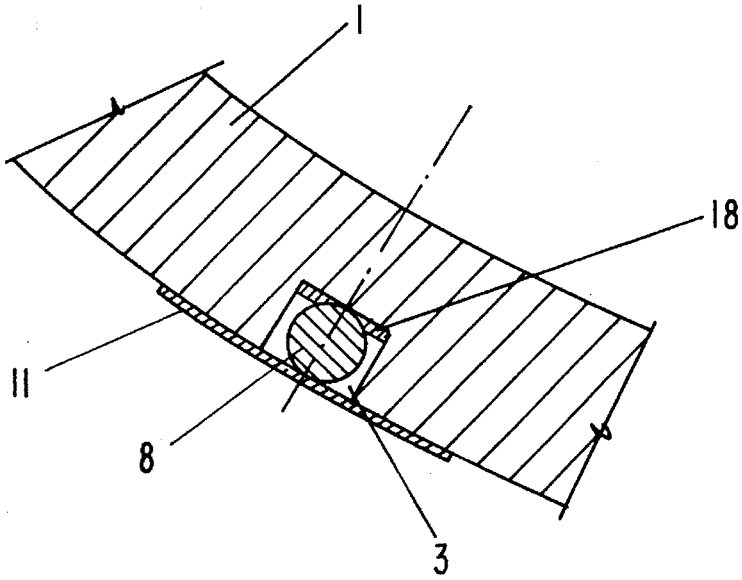
FIG. 4 shows in a representation corresponding to the one of FIG. 3 another embodiment of the receiving groove.

As shown in FIG. 3, a sealing material 7 is introduced into the receiving groove 3 which in the embodiment according to FIG. 3 is a plasticized, swellable material. As a safeguard during transport the receiving groove 3 is covered by a protective foil 11 so that the sealing material 7 is protected against mechanical damage and contact with moisture.

It may be advantageous to arrange within the receiving groove 3 a sealing material in the form of a sealing rope 8 made of an elastic, swellable material. For securing the sealing rope 8 within the receiving groove 3 it is advantageous to glue the rope 8 with an adhesive 18, to the bottom of the receiving groove 3. The sealing rope 8 has a diameter which is preferably identical to or slightly smaller than the width of the receiving groove 3. The depth of the receiving groove 3 corresponds approximately to the diameter of the sealing rope 8. A protective foil 11 for covering the receiving groove 3 protects the sealing rope 8 during transport.

Figure 5:
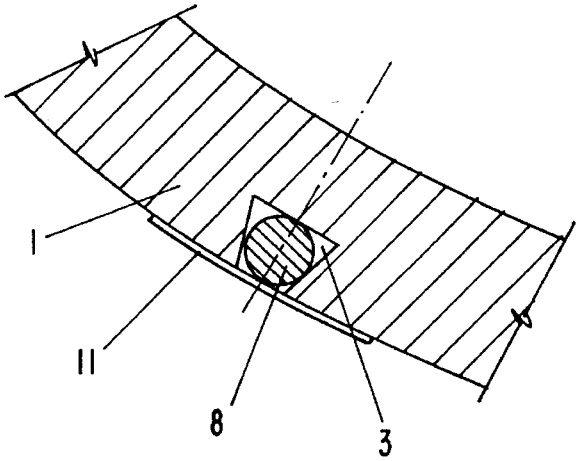
FIG. 5 shows in a representation corresponding to FIG. 3 yet another embodiment of the receiving groove.
Figure 6:
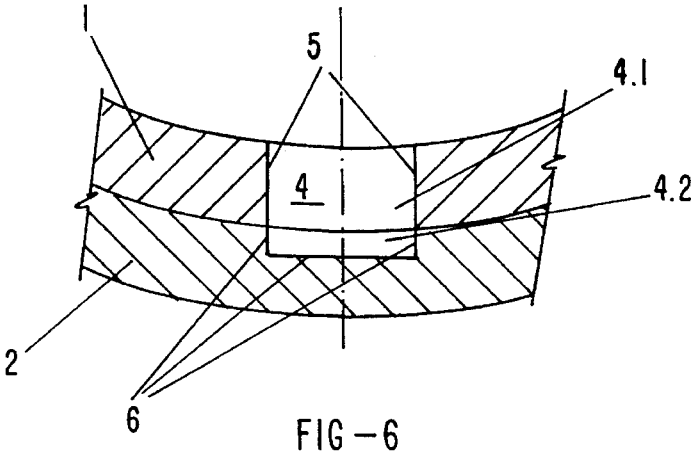
FIG. 6 shows in an enlarged representation the detail Y of FIG. 1.
Figure 7:
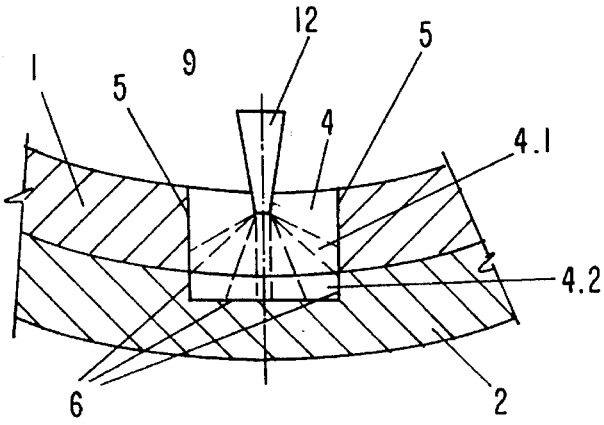
FIG. 7 is a representation according to FIG. 6 showing a nozzle for applying a sealing material onto the groove walls.

Instead of an adhesive 18 (see FIG. 5), the groove can also be designed to be undercut. In FIG. 5 the receiving groove 3 has a trapezoidal cross-section whereby the greater base of the trapezoid forms the bottom of the groove 3. The sealing rope 8 is securely held between the sides of the trapezoid whereby for securing the sealing rope 8 during transport a protective foil 11 is provided so as to cover the groove 3.

Before inserting the inner profiled member 1 into the outer profiled member 2 of the locking device the protective foil 11 (FIGS. 3, 4, and 5) is removed. When after insertion of the inner profiled member 1 into the outer profiled member 2 liquid leaks through the capillary slot 16 and reaches the sealing material, the sealing material will swell and seal the wall section 24. After cutting the inner groove 4 the fusing (welding) operation is carried out by applying the fusing (welding) material onto the walls 5 and 6 that are free of any liquid. A reliable fusing is thus ensured.

According to a further embodiment of the invention before or after cutting the groove 4 a sealing material 9 is applied to the walls 5 and 6 with a jet nozzle 12. The sealing material is preferably a liquid based on silicic acid which reacts with the suspension by silicification to thereby seal the capillary gap 16 by reacting with a cement which is contained in the suspension. This chemical reaction takes place within the capillary gap 16 between the outer wall surface 10 of the inner profiled member 1 and the inner wall surface 20 of the outer profiled member 2 because the applied sealing material leaks from the inner groove 4 into the capillary gap 16, while the suspension, respectively, the liquid contained therein enters through the gap 16 into the inner groove 4. When the sealing material and the suspension, respectively, its liquid meet, silicification occurs so that the capillary gap 16 is closed, i.e., a sealing action is achieved. The life span of this seal is sufficient to clean the walls 5 and 6 of the inner groove 4, for example, by brushing or milling, in order to subsequently fuse the cleaned walls 5 and 6 in the aforedescribed manner by applying a fusing material thereto.

Instead of spraying a liquid sealing material it is also possible to fill the hollow space 21 of the inner profiled member with the liquid sealing material so that this counteracts the hydraulic exterior pressure of the suspension. When the liquid sealing material is based on silicic acid, the aforedescribed reaction and the resulting sealing action also takes place. The excess liquid scaling material can then be removed by pumping.

It may be advantageous to cut the inner groove 4 first to a size that is smaller than the desired finished size, to then apply the sealing material 9 to the walls 5 and 6, and after completion of silicification to mill the groove 4 to the desired finished size. The finishing cutting operation also simultaneously cleans the walls 5 and 6 by removing still present sealing material so that the fusing material to be applied to the walls 5 and 6 will securely adhere thereto and provide for an intimate connection between the wall material of the profiled elements 1 and 2.

The profiled elements 1, 2 as well as the wall sections M1 and M2 and the fusing material 13 are comprised of similar plastic materials, preferably, the same plastic material, such as polyethylene, polypropylene etc.

Figure 10:
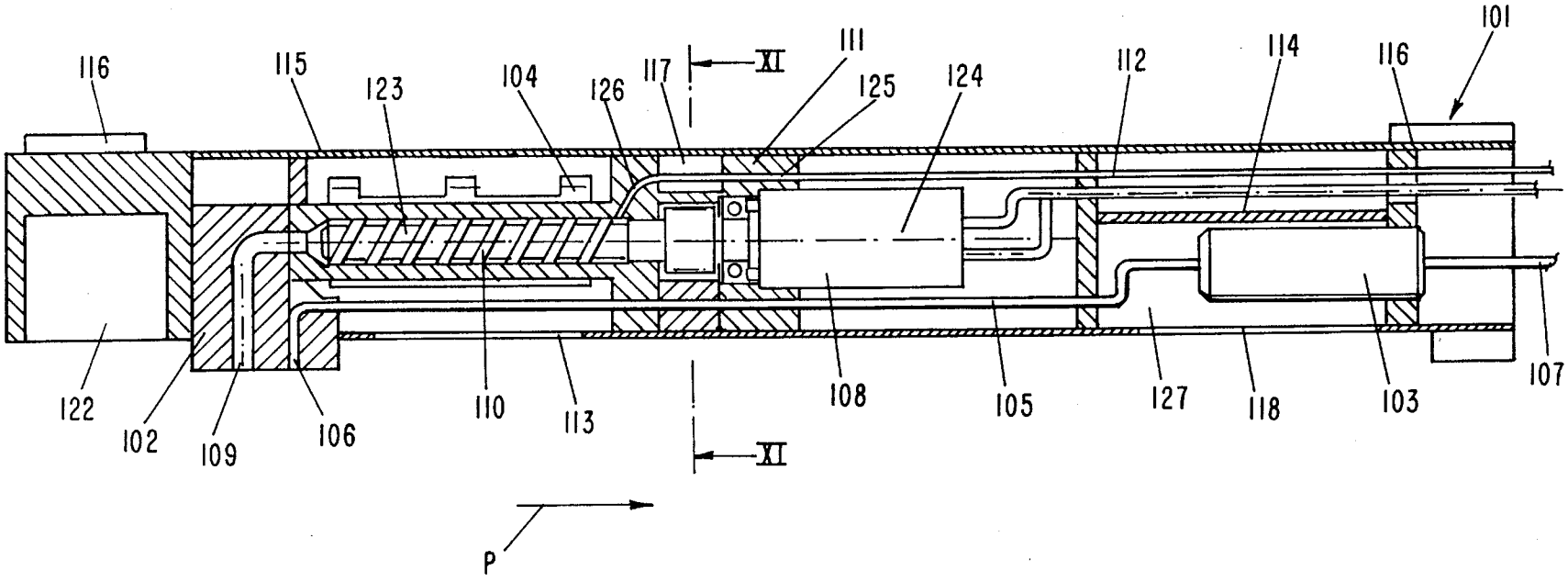
FIG. 10 shows a section along line X—X of FIG. 11 of a fusing device for producing a fusing (welding) seam.

The fusing device represented in axial section in FIG. 10 is comprised substantially of a carriage 101 having a housing 115 made of a cylindrical tube. At one end of the housing 115 a video device 122 is provided, preferably in the form of a camera etc., which is positioned directly adjacent to a radial fusing unit 102 that projects from the housing 115. The fusing unit 102 has an exit opening 109 which is connected via a channel to the extruder chamber 110. The extruder chamber 110 has the shape of a cylinder and accommodates an extruder worm gear 123 which is driven in rotation by a drive motor 108. The cylinder of the extruder chamber 110 is comprised of a heat-conducting material which is surrounded by a heating device 104 in the form of electric strip heating elements. It may be advantageous to integrate the electric heating 104 into the wall of the extruder chamber 110.

The extruder worm gear 123 as well as its drive motor 108 are preferably arranged parallel to the housing axis 124 of the carriage 101, preferably in alignment with the housing axis. However, a displacement of the axes may also be possible. The drive motor is positioned within an insert 111 in which a guide channel 125 for the fusing rope 112 is provided. The guiding channel 125 which extends parallel to the longitudinal axis 124 of the housing 115 opens into a feeding device 117 which is comprised of a friction wheel 120 that is driven via a worm gear 119 by the extruder worm gear 123. The fusing rope 112 (FIG. 11) is pressed onto the friction wheel 120 especially by a spring-loaded pressing member 121 so that a sufficient frictional connection is produced in order to pull along the fusing rope 112 upon rotation of the friction wheel 120 to thereby feed the fusing rope 112 via an inlet channel 126 opening into the extruder chamber 110 into the extruder chamber. When due to the heat within the area of the extruder chamber 110 a plasticization of the fusing rope 112 within the supply channel 126 occurs, the plasticized material is forced out of the guide channel 126 by the following fusing rope. The supply channel 126 thus will not plug up.

In the direction of fusing (arrow P) an exit channel 106 for heated air is coordinated with the exit opening 109 within the fusing unit 102 whereby the exit channel 106 is supplied with heated air from the heated air supply line 105 to which a air heating 103 is connected. The air heating device 103 is positioned in a chamber 127 which is separate from the housing 115 and which is especially insulated with a thermally insulating wall 114 relative to the feeding device 117 and the fusing rope 112 guided therein. The heating device 103 is supplied with air via line 107.

In the direction of fusing (arrow P) upstream of the fusing device 101 housing windows 113 and 118 are provided whereby the housing window 118 is positioned at the level of the chamber 127 so that the heat radiating off the heating device 103 preheats the inner groove to be fused.

The hot air line 105 is guided on the side of the extruder facing away from the welding unit 102 to the exit channel 106 whereby above the welding unit 102 the housing window 113 is positioned. The heat radiated off the hot air line 105 thus serves to preheat the inner groove to be fused.

The housing 115 is provided about its periphery with preferably radially spring-loaded support elements 116 whereby in one circumferential plane preferably two support elements with equidistant spacing are arranged. The spring-loaded support elements 116 are supported at the wall of the inner profiled members and provide the required fusing pressure for the fusing unit 102. For fusing the profiled members the fusing device is inserted into the inner profiled member whereby the fusing unit 102 is inserted into the previously cut inner groove 4 and thereby correctly positions the fusing device in the circumferential direction. Starting at the bottom of the profiled member plasticized material, for example, high density polyethylene, is forced by the extruder worm gear 123 via the exit opening 109 into the inner groove 4. Upon movement in the feeding direction P the inner groove 4 is preheated by radiant heat radiating via the housing windows 118 and 113 and is then heated by hot air within the area of the exit channel 106 to the required fusing temperature. The plasticized fusing material is inserted into the inner groove whereby the groove walls plasticized due to heating will undergo an intimate connection with the plasticized fusing material introduced into the groove so that the inner groove is fused in a liquid-tight manner.

The present invention is, of course, in no way restricted to the specific disclosure of the specification and drawings, but also encompasses any modifications within the scope of the appended claims.

What we claim is:

1. A method for connecting in a liquid-tight manner cooperating lock halves of a locking device of adjacent wall sections of a multi-sectioned wall introduced into a suspension, said method comprising the steps of:

providing a first one of said cooperating lock halves as an inner profiled member with a wall having an outer wall surface and a second one of said cooperating lock halves as an outer profiled member with a wall having an inner wall surface;

inserting said inner profiled member into said outer profiled member so that said inner and outer wall surfaces of said inner and outer profiled members substantially areally rest at one another and form a capillary gap therebetween;

cutting an inner groove substantially over a length of said inner and outer profiled members such that said inner groove extends through said wall of said inner profiled member into said wall of said outer profiled member;

fusing said inner and outer profiled members with a fusing material introduced into said inner groove; and before said step of inserting, positioning a sealing material between said inner and said outer wall surfaces of said inner and outer profiled members to surround an area of said inner and outer walls where said inner groove is to be located, wherein said sealing material is arranged on one of said inner and outer walls in order to seal said area where said inner groove is to be located against the suspension into which the multi-sectioned wall is introduced.

2. A locking device for connecting in a liquid-tight manner cooperating lock halves of adjacent wall sections of a multi-sectioned wall introduced into a suspension, wherein an inner profiled member and an outer profiled member form cooperating lock halves of the locking device and the inner profiled member is inserted into the outer profiled member so that the inner and outer profiled members substantially areally rest at one another, wherein an inner groove is cut substantially over a length of the inner and outer profiled members such that the inner groove extends through a wall of the inner profiled member into a wall of the outer profiled member and the inner and outer profiled members are fused with a fusing material introduced into the inner groove; said locking device comprising:

an outer profiled member connected to a vertical edge of a first wall section and having an inner wall surface;

an inner profiled member connected to a vertical edge of a second wall section and having an outer wall surface;

said inner profiled member inserted into said outer profiled member such that said outer wall surface substantially areally rests at said inner wall surface; and a sealing material connected to at least one of said inner wall and said outer wall, wherein said sealing material, when said inner profiled member is inserted into said outer profiled member, surrounds an area of said inner and said outer wall surfaces where the inner groove is to be cut.

3. A locking device according to claim 2, wherein said sealing material swells when subjected to moisture.

4. A locking device according to claim 2, wherein said sealing material is a plasticized material.

5. A locking device according to claim 2, wherein:

said at least one of said inner and said outer wall surfaces has a receiving groove; and said sealing material is positioned in said receiving groove and is in the form of a shaped elastic material.

6. A locking device according to claim 5, wherein said shaped elastic material is a sealing rope.

7. A locking device according to claim 5, wherein said receiving groove is completely filled with said shaped elastic material.

8. A locking device according to claim 5 wherein said shaped elastic material is fastened within said receiving groove by gluing.

9. A locking member according to claim 5, further comprising a protective foil for covering said receiving groove with said shaped elastic material positioned therein.

10. A locking member according to claim 5, wherein said receiving groove has a trapezoidal cross-section.

11. A locking member according to claim 5, wherein said receiving groove is located in said outer wall surface.

12. A locking member according to claim 11, wherein said receiving groove is U-shaped, wherein the opening of the U is facing an upper end of said inner profiled member and wherein said receiving groove ends at said upper end of said inner profiled member.

13. A locking member according to claim 5, wherein said receiving groove is U-shaped, wherein the opening of the U is facing an upper end of said at least one inner and outer profiled members and wherein said receiving groove ends at said upper end.

14. A locking member according to claim 2, wherein a lower end of said inner profiled member is closed.

* * * * *